US005944912A

United States Patent [19]

Jenkins et al.

[11] Patent Number: 5,944,912

[45] Date of Patent: Aug. 31, 1999

[54] CLEANING SOLUTION APPARATUS AND METHOD

[76] Inventors: Michael Jenkins; Janice Jenkins, both of 7 Beacon Hill, Pompton Lakes, N.J. 07442

[21] Appl. No.: 08/789,094

[22] Filed: Jan. 27, 1997

[51] Int. Cl.[6] ..... C11D 3/39; C11D 7/18

[52] U.S. Cl. ..... 134/40; 134/42; 510/109; 510/365; 510/367; 510/372; 510/382; 510/405

[58] Field of Search ..... 134/40, 42; 510/109, 510/365, 367, 372, 382, 383, 405, 407

[56] References Cited

U.S. PATENT DOCUMENTS 5,584,888 12/1996 Miracle et al. ..... 8/111
5,736,497 4/1998 Steiner ..... 510/303

OTHER PUBLICATIONS

Chemical Dictionary A: pp. 6–7,28–33;112–113,144–145, 236–237,246–247,250–253,306–307,322–323,378–379, and 496–497.

Chemical Dictionary B: pp. 170,363,530,754,760,761,845, 943,959,1055,1138,1141,1166,1207,1247,1351,1368,1386, 1397,1364, and 1429.

Microsoft Internet Explorer re Benzoic Acid definition, undated.

*Primary Examiner*—Ponnathapura Achutamurthy
*Attorney, Agent, or Firm*—Walter Tencza, Jr.

[57] ABSTRACT

An oxidizer, preferably hydrogen peroxide, is used for cleaning the finger holes in a bowling ball and for cleaning the inserts which are placed in those holes. The hydrogen peroxide is preferably provided as part of a solution which is substantially similar to a "hair neutralizer". However a simple hydrogen peroxide 3% solution can be used, where about 3% of the solution is hydrogen peroxide and about 97% of the solution is water, by weight. In this simple 3% solution, the only other chemical, other than water and hydrogen peroxide, which may in one embodiment be provided, is a stabilizer, in typically a small percentage. The hydrogen peroxide solution can be placed or soaked onto a towlette. The towlette should be placed in a sealed plastic packet to prevent it from drying out. The hydrogen peroxide solution can then be applied to cleaning the holes in bowling balls and the inserts in bowling balls, and can also be applied to known uses such as an antiseptic to be applied to skin.

14 Claims, 1 Drawing Sheet

CLEANING SOLUTION APPARATUS AND METHOD

FIELD OF THE INVENTION

This invention relates to methods of using chemical solutions and apparatus for dispensing chemical solutions.

BACKGROUND OF THE INVENTION

Hydrogen peroxide is an oxidizer. For non-industrial uses, it is used in small quantities, typically in a 3% solution, where the hydrogen peroxide is about 3% and the diluting water is about 97% by weight. In this 3% solution form, hydrogen peroxide is used as an antiseptic and cleansing agent to be applied to skin. It is also used to clean metal surfaces. Hydrogen peroxide 3% solution is also used in mouthwashes, dentrifices, and sanitary lotions. Another use of hydrogen peroxide is in "hair neutralizers". Hair neutralizers are used by hair dressers to "fix" or "lock in" a permanette hair style after a permanent solution has been applied.

Towlettes are known which are prepared with various chemicals which allow them to remain moist over a long period of time. These towlettes are used in restaurants for wiping hands and for cleansing a baby's private parts during a diaper change.

SUMMARY OF THE INVENTION

The present invention in one form discloses the use of an oxidizer, preferably hydrogen peroxide, for cleaning bowling ball equipment such as a bowling ball or the inserts for use in the finger holes of a bowling ball. Preferably the oxidizer is used to clean the finger holes of the bowling ball or the exterior of the bowling ball. The hydrogen peroxide is preferably provided as part of a solution which is preferaby identical or nearly identical to a "hair neutralizer" as known in the hair dressing field. However a simple hydrogen peroxide 3% solution can be used, where about 3% of the solution is hydrogen peroxide and about 97% of the solution is water, by weight. In this simple 3% solution, the only other chemical, other than water and hydrogen peroxide, which is typically provided, is a stabilizer, which can be phosphoric acid. The phosphoric acid can be 0.0001% of the total solution.

In another form of the invention, the hydrogen peroxide solution is incorporated into a towlette, such as by towlette. Each individual towlette is preferably then sealed in a sealable plastic packet, such as a ZIP-LOCK (trademark) plastic or cellophane storage bag, in order to prevent the towlette from drying out. The hydrogen peroxide solution can then be applied to such new uses in accordance with the present invention, as cleaning the holes in bowling balls and the inserts in bowling balls, and can also be applied to uses which are generally known for hydrogen peroxide without a towlette, such as an antiseptic to be applied to skin.

DETAILED DESCRIPTION OF THE DRAWINGS

Figure 1:
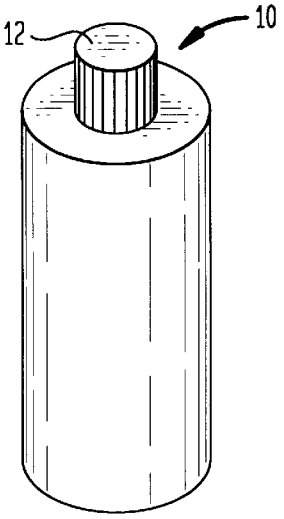
FIG. 1 shows a bottle for dispensing the solution in accordance with the present invention.

FIG. 1 shows a bottle 10 for dispensing the solution for use in accordance with the present invention. The bottle 10 has a cap 12. The bottle 10 may be in any form known in the art for dispensing a solution. However, it is preferred that the bottle 10 have a top with an air tight seal as known so that the solution doesn't lose its potentcy.

Figure 4:
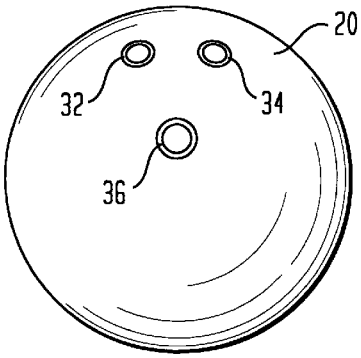
FIG. 4 shows a bowling ball with finger inserts.

The solution stored in the bottle 10 preferably has the chemical composition of a "hair neutralizer". In the prior art a "hair neutralizer" was used to "lock" in the curl of a permanent in the hair dressing field. However, in at least one embodiment of the present invention a solution, preferably a hair neutralizer, is used to clean a material. Preferably the solution is used to clean the finger holes 22, 24, and 26 of a bowling ball 20 shown in FIG. 2 or inserts such as inserts 32, 34, and 36 shown in FIG. 3. The inserts 32, 34, and 36 can be placed in the finger holes 22, 24, and 26 as shown in FIG. 4. The inserts 32, 34, and 36 are often glued into the holes 22, 24, and 26 respectively or can be fixed in any other manner known in the art. The bowling ball 20 also has an exterior surface 28.

Figure 2:
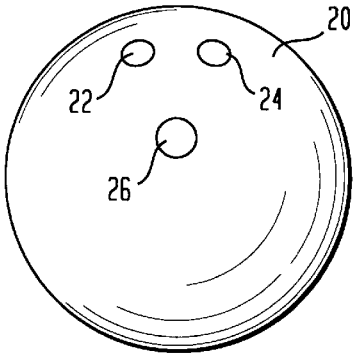
FIG. 2 shows a bowling ball without finger inserts.
Figure 3:
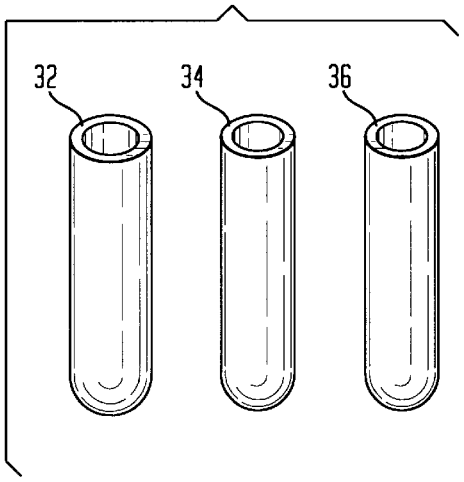
FIG. 3 shows three bowling ball finger inserts.

Bowling balls, and in particular the holes, such as holes 22, 24, and 26 in FIG. 2 of the bowling ball 20 often become filled with glue, oil, grease, dirt, and other unwanted agents or debris. These materials make it difficult for the bowler to properly grip and/or release the ball. There is a need to quickly clean the holes without making them wet or sticky and without leaving an undesired residue of material or smell in the ball. The inventors have determined that a "hair neutralizer" solution when applied to the holes of a bowling ball, quickly and thoroughly cleans the holes. The "hair neutralizer" solution dries quickly which is important for a bowler who has picked up a used ball in a bowling alley and wants to clean it and then immediately use it. The "hair neutralizer" solution is also suitable for use on inserts which often are placed in the holes of bowling balls. These inserts also often become covered with dirt, glue, oil, grease, or other unwanted materials.

Some common hair neutralizers which are suitable for this use of the present invention are a Hair Neutralizer by L'OREAL (trademark) having the ingredients of Water, Hydrogen Peroxide, Oleth-20, Cocamidopropyl, Hydroxysultaine, Fragrance, Styrene/PVP Copolymer, Polyquaternium-4, Citric Acid, Oxypuinoline Sulfate.

A hair neutralizer by Toni (trademark) is also suitable and includes Water, Mineral oil, Hydrogen Peroxide Sorbitan Palmitate, Proplyene Glycol, Lanolin, Polysorbate 40, Stearalkonium Chloride, Phenacetin, Stearyl Alcohol, Dimethyl Stearamine, Benzoic Acid, Fragrance, Hydrocholic Acid, Sodium Stannate.

A hair neutralizer by Ogilvie (trademark) includes water, hydrogen peroxide, quaternium 52, Cetearyl Alcohol, Sodium Lauryl Sulfate, Ceteth-20, Methylparaben, Fragrance, Disodium, Phosphatic Acid.

A hair neutralizer by Matrix (trademark) includes Water, Hydrogen Peroxide, Amodimethicone, Nonoxynol-10, Tallowtrimonium Chloride, Dicetyldimonium Chloride, Methylparaben, Simethicone, Cystine, Histidine Hydrochloride, Lysine Hydrochloride, Methionine, Tyrosine, Phosphoric Acid.

Other companies which also manufacture hair neutralizers which may be suitable for the use of the present invention are: Zoto's (trademark), Lamaur (trademark), Helene Curtis (trademark), Gheri Redding (trademark), Naturelle (trademark), Bonat (trademark), Quantum (trademark), Red Ken (trademark), Wella (trademark), and Rusk (trademark).

The hair neutralizer by Matrix is preferred and it is preferred that "color" be added to that solution, to distinguish the solution from water or clear liquids. The color added could be red or yellow or any other color. Rubbing alcohol, also known as halide is also preferably added. This helps the solution to dry even faster. However, the product can be made with or without rubbing alcohol.

Each of the hair neutralizers discussed herein were upon information and belief being manufactured at the time of filing of this application.

The solution applied to cleaning the finger holes of the bowling ball may be, alternatively, a simple hydrogen peroxide 3% solution. Hydrogen peroxide has the particular advantage of drying quickly after application. This is particularly important to a bowler who wants to clean out oil, grease, etc., but also wants to have dry finger holes. The hair neutralizers described previously all contain hydrogen peroxide.

Figure 5:
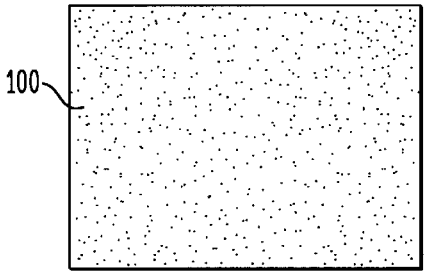
FIG. 5 shows an individual towlette.
Figure 6:
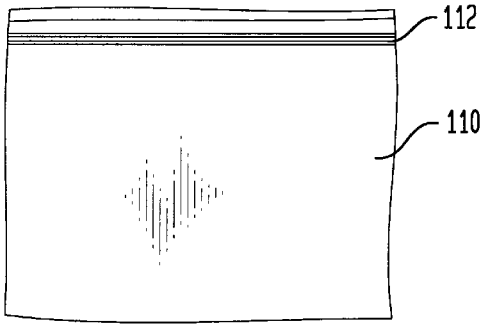
FIG. 6 shows a plastic packet for storing an individual towlette.
Figure 7:
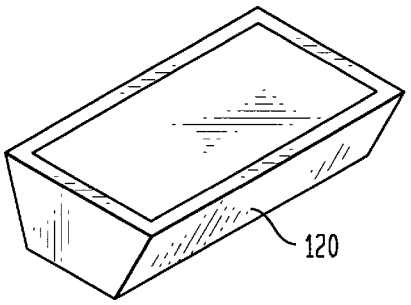
FIG. 7 shows a plastic case for storing towlettes.

In another form of the present invention the hair neutralizer solution is incorporated with other chemicals for use in a towlette. FIG. 5 shows an individual towlette 100; FIG. 6 shows a ZIP-LOCK storage bag for placing the individual towlette 100; and FIG. 7 shows a plastic case 120 for storing towlette 100 and other identical towlettes. In addition to the hair neutralizer chemicals which have been described the following chemicals are preferably also incorporated into the moist towlette: Proplyene glycol, Cocoamphodiacetate, Polysorbate 20, Sodium Bicarbonate, Methylparaben, Propylparaben, Pentadecalactone, and Sodium Hydroxymethylglycinate. These additional chemicals are included in Baby Fresh Gentle Touch Soft Cloths (trademark) with baking soda. Other existing towlette chemicals may be combined with the hair neutralizers discussed herein. Alternatively, hydrogen peroxide 3% solution may, along with a stablizer such as phosphoric acid, only be combined with the moist towlette chemicals.

The plastic case 120 shown in FIG. 7, may be any sealable plastic case known in the art such as used for Baby Fresh Gentle Touch Soft Cloths (trademark) with baking soda and other moist towlettes known in the art.

The moist towlette with hydrogen peroxide can be used for cleaning bowling ball finger holes or inserts, or for applying to skin as an antiseptic. The moist towlettes may be provided in individualized packets, i.e. one sheet for each packet. Such as the sealable ZIP-LOCK storage bag 110 which is a packet which can be sealed. The packet is sealed by sealable area or ZIP-LOCK (trademark) 112 as known in the art. This may be advantageous to keep the moist towlettes in a moist state. The packets are preferably plastic but can be other materials.

The hair neutralizer solutions have the advantage of not leaving a substantial residue and also of not leaving an unfavorable odor. These solutions also have the advantage of drying quickly. These solutions remove oil buildup, adhesives such as tape, and are generally safe for the skin.

We claim:

1. A method of using a solution, wherein the solution is a hair neutralizer comprised of water, Hydrogen Peroxide, Quaternium 52, Cetearyl Alcohol, Sodium Lauryl Sulfate, Ceteth-20, Methylparaben, Fragrance, Disodium Phosphatic Acid; the method comprising:

applying the solution to bowling ball equipment in order to clean the bowling ball equipment.

2. A method of using a solution, wherein the solution is a hair neutralizer comprised of water, Hydrogen Peroxide, Oleth-20, Cocamidopropyl, Hydroxysultaine, Fragrance, Styrene/PVP Copolymer, Polyquaternium-4, Citric Acid, and Oxypuinoline Sulfate, the method comprising:

applying the solution to bowling ball equipment in order to clean the bowling ball equipment.

3. The method of claim 2 wherein the solution is applied to the finger holes of a bowling ball and wherein the bowling ball is immediately used after the solution is applied.

4. The method of claim 2 wherein the solution is applied to inserts for use in the finger holes of a bowling ball and wherein the bowling ball is immediately used after the solution is applied.

5. The method of claim 2 wherein the solution is applied to the exterior surface of a bowling ball and wherein the bowling ball is immediately used after the solution is applied.

6. The method of claim 1 wherein:

the solution is applied to the finger holes of a bowling ball and the bowling ball is immediately used after the solution is applied.

7. A method of using a solution, wherein the solution is a hair neutralizer comprised of water, Mineral Oil, Hydrogen Peroxide Sorbitan Palmitate, Proplyene Glycol, Lanolin, Polysorbate 40, Stearalkonium Chloride, Phenacetin, Stearyl Alcohol, Dimethyl Stearamine, Benzoic Acid, Fragrance, Hydrocholic Acid, and Sodium Stannate, the method comprising:

applying the solution to bowling ball equipment in order to clean the bowling ball equipment.

8. A method of using a solution wherein the solution is a hair neutralizer and is comprised of Amodimethicone, Nonoxymol-10, Tallowtrimonium Chloride, Dicetyldimonium, Chloride, Methylparaben, Simethicone, Cystine, Histidine Hydrochloride, Lysine Hydrochloride, Methionine, Tyrosine, and Phosphoric Acid, the method comprising:

applying the solution to bowling ball equipment in order to clean the bowling ball equipment.

9. The method of claim 1 wherein the solution is first incorporated into a towlette and then applied to the bowling ball equipment.

10. The method of claim 7 wherein the solution is first incorporated into a towlette and then applied to the bowling ball equipment.

11. The method of claim 8 wherein the solution is first incorporated into a towlette and then applied to the bowling ball equipment.

12. The method of claim 7 wherein:

the solution is applied to the finger holes of a bowling ball and the bowling ball is immediately used after the solution is applied.

13. The method of claim 8 wherein:

the solution is applied to the finger holes of a bowling ball and the bowling ball is immediately used after the solution is applied.

14. The method of claim 2 wherein the solution is first incorporated into a towlette and then applied to the bowling ball equipment.

* * * * *